US008087802B1

(12) United States Patent
Hull

(10) Patent No.: US 8,087,802 B1
(45) Date of Patent: Jan. 3, 2012

(54) COMPACT FLORESCENT LAMP COVER

(76) Inventor: David C. Hull, Roseville, CA (US)

( * ) Notice: Subject to any disclaimer, the term of this patent is extended or adjusted under 35 U.S.C. 154(b) by 360 days.

(21) Appl. No.: 12/151,313

(22) Filed: May 6, 2008

(51) Int. Cl.
*F21V 14/00* (2006.01)

(52) U.S. Cl. ..... 362/260; 362/255; 362/216; 362/396

(58) Field of Classification Search ..... 362/255, 362/216, 260, 396, 452, 438, 186, 440, 442
See application file for complete search history.

(56) References Cited

U.S. PATENT DOCUMENTS

| | | | | |
|---|---|---|---|---|
| 576,267 | A | 2/1897 | Green | |
| 707,433 | A | 8/1902 | Livet | |
| 794,296 | A | 7/1905 | Gille | |
| 1,017,173 | A | 2/1912 | Ryan | |
| 1,090,465 | A | 3/1914 | Evans | |
| 1,117,131 | A | 11/1914 | Green | |
| 1,211,772 | A | 1/1917 | Smith | |
| 1,245,855 | A | 11/1917 | Anderson | |
| 1,249,364 | A | 12/1917 | Finizio | |
| 1,291,510 | A | 1/1919 | Herskovitz | |
| 1,566,327 | A | 12/1925 | Johnson | |
| 1,573,489 | A | 2/1926 | Hall | |
| 1,759,985 | A | 5/1930 | Jenkins | |
| 1,765,212 | A | 6/1930 | Decker | |
| 1,774,512 | A | 9/1930 | Hinman | |
| 1,809,878 | A | 6/1931 | Whitman | |
| 2,126,650 | A | 8/1938 | Matera | |
| 2,271,515 | A | 2/1942 | Ulett | |
| 5,605,391 | A | 2/1997 | Wood | |
| 7,434,961 | B1 * | 10/2008 | Bernhardt et al. | 362/255 |

* cited by examiner

*Primary Examiner* — Anabel Ton
(74) *Attorney, Agent, or Firm* — Thomas R. Lampe

(57) ABSTRACT

A cover for a spiral-type compact florescent lamp includes a cover body and a connector extending from the cover body to the compact florescent lamp and connecting the cover to the compact florescent lamp with the cover body disposed adjacent to the lamp coil structure and covering the lamp coil structure.

2 Claims, 4 Drawing Sheets

COMPACT FLORESCENT LAMP COVER

TECHNICAL FIELD

This invention relates to a cover for spiral-type compact florescent lamps having lamp coil structure. The cover is particularly useful to conceal compact florescent lamps (commonly known as CFLs) when utilized in lighting fixtures with exposed bulbs, examples being can lights, vanity lights and ceiling fans.

BACKGROUND OF THE INVENTION

Compact florescent lamps are increasingly being employed as replacements for ordinary incandescent lamp bulbs.

They are energy efficient and long lasting. Many jurisdictions are requiring usage of compact florescent lamps in both homes and commercial buildings.

Unless covered, CFLs are relatively unsightly. As discussed in greater detail below, the function of the invention disclosed and claimed herein is not only to conceal CFLs, but also protect them against damage. The invention relates to a CFL cover that will fit the vast majority of CFLs currently on the market and does not require modification for use with current CFL parts or manufacturing methods. The cover is relatively small, simple and inexpensive to manufacture. The cover does not envelope the CFL bulb, allowing improved heat dissipation. Direct contact with the CFL cross member allows the cover to act as a heat sink.

While it is well known to employ shades, covers, lenses or the like in connection with ordinary light bulbs, the arrangements known in the prior art are not particularly suitable for use with spiral-type compact florescent lamps. In addition, many such prior art devices are relatively complex and expensive.

The following patents are believed to be representative of the current state of the prior art in this field: U.S. Pat. No. 2,271,515, issued Feb. 3, 1942, U.S. Pat. No. 576,267, issued Feb. 2, 1897, U.S. Pat. No. 5,605,391, issued Feb. 25, 1997, U.S. Pat. No. 2,126,650, issued Aug. 9, 1938, U.S. Pat. No. 1,809,878, issued Jun. 16, 1931, U.S. Pat. No. 1,774,512, issued Sep. 2, 1930, U.S. Pat. No. 1,765,212, issued Jun. 17, 1930, U.S. Pat. No. 1,759,985, issued May 27, 1930, U.S. Pat. No. 1,573,489, issued Feb. 16, 1926, U.S. Pat. No. 1,566,327, issued Dec. 22, 1925, U.S. Pat. No. 1,291,510, issued Jan. 14, 1919, U.S. Pat. No. 1,245,855, issued Nov. 6, 1917, U.S. Pat. No. 1,211,772, issued Jan. 9, 1917, U.S. Pat. No. 1,117,131, issued Nov. 10, 1914, U.S. Pat. No. 1,090,465, issued Mar. 17, 1914, U.S. Pat. No. 1,017,173, issued Feb. 13, 1912, U.S. Pat. No. 794,296, issued Jul. 11, 1905, U.S. Pat. No. 707,433, issued Aug. 19, 1902 and U.S. Pat. No. 1,249,364, issued Dec. 11, 1917.

DISCLOSURE OF INVENTION

The cover of the present invention is characterized by its ease of use, relatively low cost and ease of installation on or removal from a spiral-type compact florescent lamp having lamp coil structure. The cover includes a cover body translucent over at least a portion thereof and a connector extending from the cover body to a compact florescent lamp and connecting the cover to the compact florescent lamp with the cover body disposed adjacent to the lamp coil structure and covering the lamp coil structure. The connector comprises a clip releasably engaging the lamp coil structure.

Other features, advantages and objects of the present invention will become apparent with reference to the following description and accompanying drawings.

MODES FOR CARRYING OUT THE INVENTION

Figure 1:
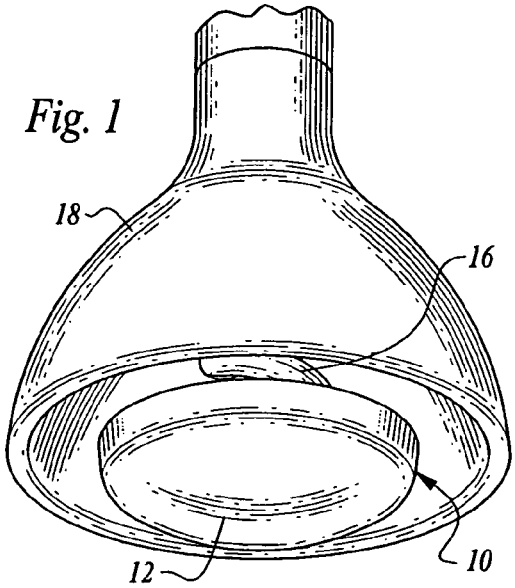
FIG. 1 is a perspective view illustrating a cover constructed in accordance with the teachings of the present invention connected to a spiral-type compact florescent lamp in a light fixture.
Figure 2:
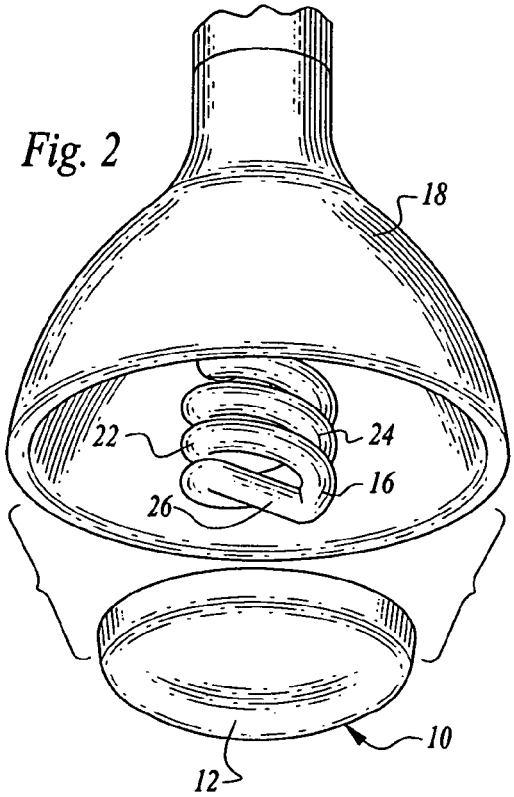
FIG. 2 is an exploded, perspective view showing the cover removed from the compact florescent lamp and fixture.
Figure 3:
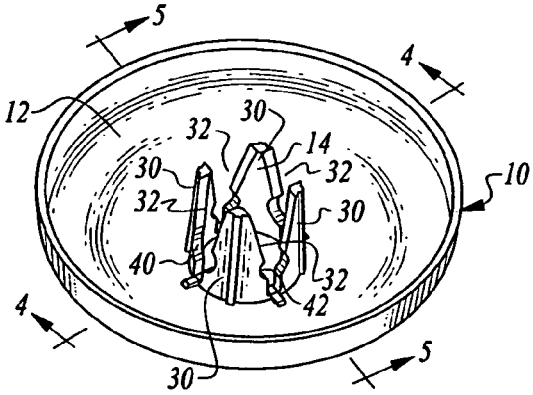
FIG. 3 is an enlarged, perspective view of the inner cover illustrating details of a clip.

FIGS. 1-5 illustrate a cover or lens 10 constructed in accordance with the teachings of the present invention. Cover 10 includes a translucent cover body 12 and a translucent connector in the form of a clip 14, the cover body and clip in this embodiment being of one-piece construction and made for example from molded plastic. The clip is employed to releasably connect the cover to a compact florescent lamp 16 of conventional construction. FIGS. 1 and 2 show the compact florescent lamp screwed into place in the socket of a typical light fixture 18.

The compact florescent lamp is of the well known spiral-type, including lamp coil structure having lamp coils 22, 24 interconnected by a tubular lamp cross-member 26.

The clip 14 extends from the cover body 12 to the compact florescent lamp 16 and connects the cover to the lamp with the cover body disposed adjacent to but spaced from the lamp coil structure and covering the lamp coil structure.

The clip 14 includes a plurality of clip legs 30 defining spaces 32 therebetween. The clip legs are resilient and have an elastic memory.

In the arrangement illustrated in FIGS. 1-5, four clip legs 30 are shown, the clip legs defining four spaces 32. Adjacent clip legs exert opposed clamping forces on the lamp coil structure when the cover is positioned thereon. More particularly, the clip 14 is releasably connected to the tubular lamp cross-member 26 to hold the cover in place. The tubular lamp cross-member is located in two spaces in opposition to one another. When in position, two clip legs 30 are disposed on each of the sides of the tubular lamp cross-member and frictionally engage the tubular lamp cross-member.

Figure 4:
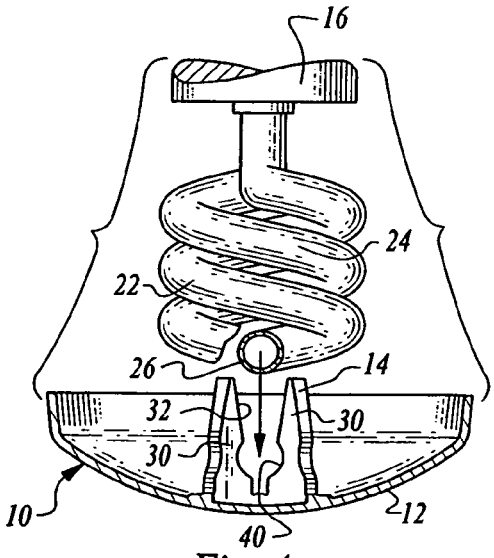
FIG. 4 is a cross-sectional view of the cover taken along 4-4 of FIG. 3 depicting the cover receiving a compact florescent lamp.
Figure 5:
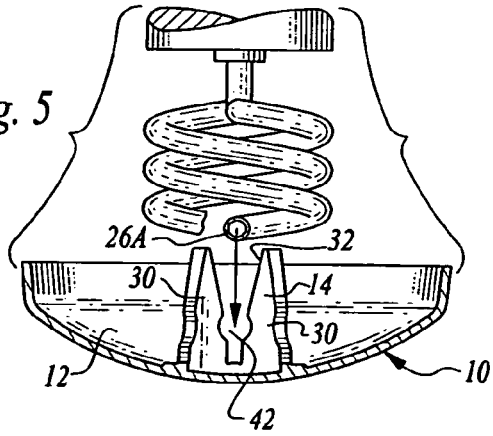
FIG. 5 is a view similar to FIG. 4, but providing a cross-section of the cover as taken along line 5-5 of FIG. 3 and prior to connection to a spiral-type compact florescent lamp having smaller diameter coils than the lamp of FIG. 4.
Figure 6:
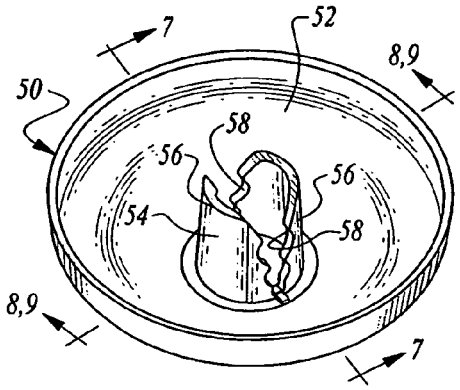
FIG. 6 is a view similar to FIG. 3, but illustrating a second embodiment of the cover of the invention.
Figure 7:
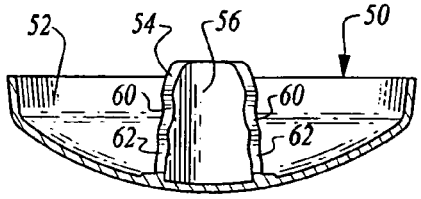
FIG. 7 is a cross-sectional view taken along line 7-7 in FIG. 6.

The cover shown in FIGS. 1-5 is adapted for use with compact florescent lamps having different sized tubular lamp cross-members. FIGS. 4 and 5 show, respectively, a large diameter tubular lamp cross-member 26 and a smaller tubular lamp cross-member 26A. Two of the spaces 32 in opposition to one another define openings 40 larger than the openings 42 defined by the other two spaces in opposition to one another. When the clip is applied to a larger diameter tubular lamp cross-member, the cover is oriented as shown in FIG. 4 so that the tubular lamp cross-member enters the opposed spaces having the larger openings 40, the tubular lamp cross-member 26 introduced into the large diameter openings through tapered passageways of the spaces until the tubular lamp cross-member is releasably locked in position in the larger openings 40 and maintained therein by the clip legs on opposed sides of the tubular lamp cross-member. FIG. 5 shows the clip oriented so that the tubular lamp cross-member 26A will be seated and releasably locked in position in smaller openings 42.

FIGS. 6-9 illustrate an alternative cover embodiment 50. Cover 50 includes a cover body 52 integral with a clip 54. Clip 54 has two clip legs 56 disposed in opposition to one another and defining therebetween two spaces 58 of identical configuration disposed in opposition to one another. Each space 58 includes openings 60, 62 adjacent to one another. The two openings are of different sizes, opening 60 being larger than opening 62.

Figure 8:
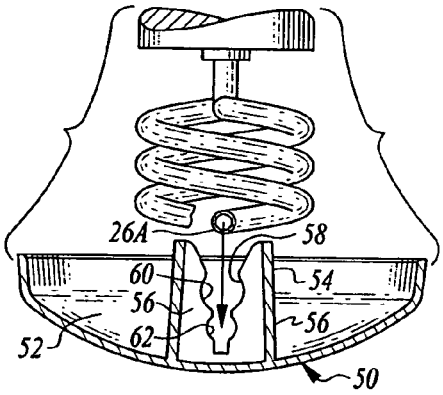
FIGS. 8 and 9 illustrate the cover of the second embodiment in cross-section as taken along line 8,9-8,9 in FIG. 6, the compact florescent lamp shown in FIG. 9 having larger diameter coils than that illustrated in FIG. 8.
Figure 9:
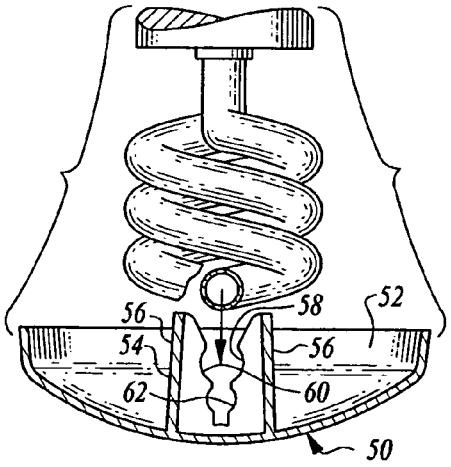

This embodiment of the invention is also adapted for use with different sized spiral-type compact florescent lamps. More particularly, FIG. 8 shows a tubular lamp cross-member 26A of a spiral-type compact florescent lamp prior to insertion into small opening 62, the latter being sized to allow clip legs 56 to releasably engage the tubular lamp cross-member 26A and retain the cover 50 in position on the compact florescent lamp. FIG. 9, on the other hand, shows a larger tubular lamp cross-member 26 being positioned into the larger opening 60, tubular lamp cross-member 26 being too large to enter the small opening 62. Whether employed with large or small tubular lamp cross-members, the clip legs 56 will bear thereagainst and releasably retain the cover in position.

Figure 10:
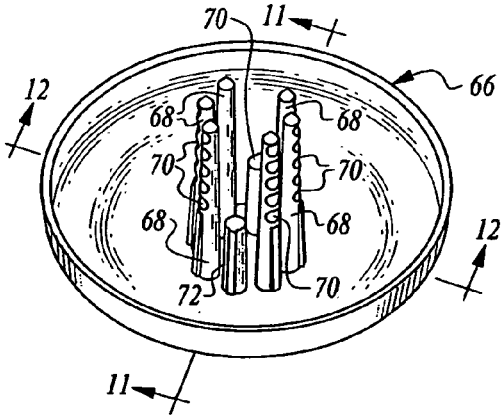
FIG. 10 is a view similar to FIGS. 3 and 6 illustrating a third cover embodiment.
Figure 11:
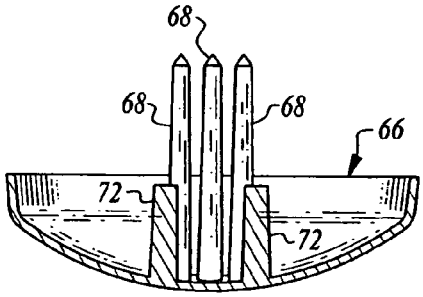
FIG. 11 is a cross-sectional view of the cover of the third embodiment taken along the line 11-11 in FIG. 10.
Figure 12:
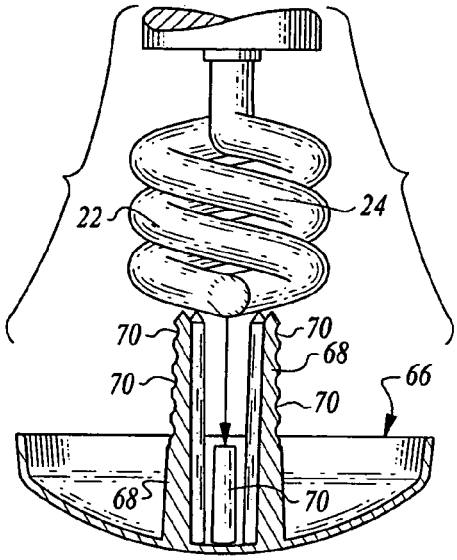
FIG. 12 is a cross-sectional view of the third cover embodiment taken along line 12-12 in FIG. 10, but showing the cover being removed from a spiral-type compact florescent lamp.
Figure 13:
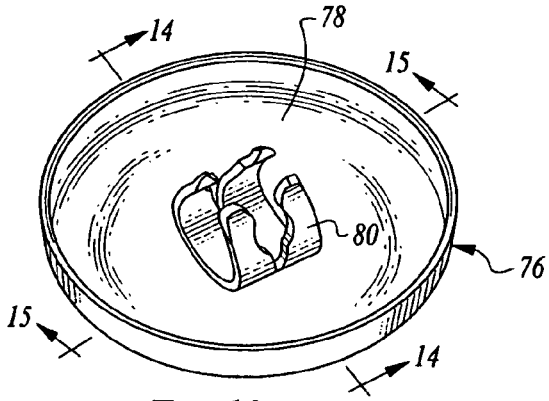
FIG. 13 is a view similar to FIGS. 3, 6, and 10 of a fourth embodiment of the cover.
Figure 14:
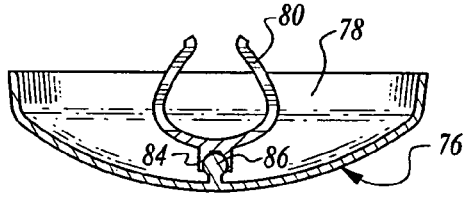
FIG. 14 is a cross-sectional view taken along line 14-14 of FIG. 13.
Figure 15:
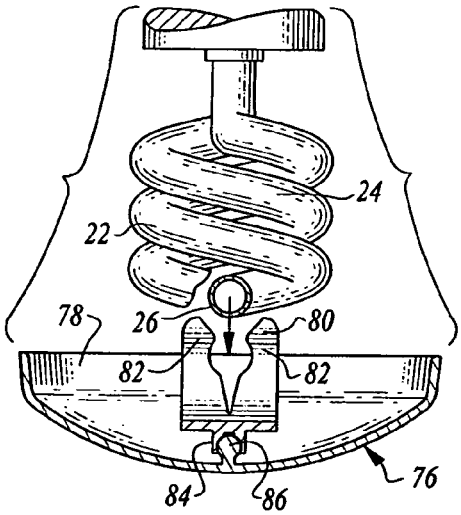
FIG. 15 is a cross-sectional view of cover fourth embodiment taken along line 15-15 of FIG. 13, the cover being removed from the spiral-type compact florescent lamp.
Figure 16:
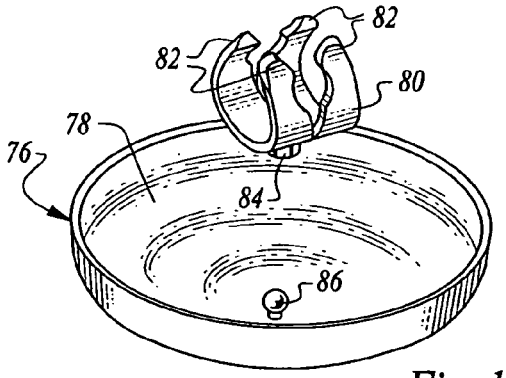
FIG. 16 is a perspective view illustrating the cover body and clip components of the fourth embodiment of the cover separated.
Figure 17:
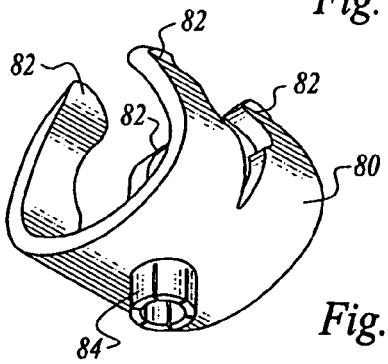
FIG. 17 is an enlarged, perspective view of the clip of the fourth embodiment

FIGS. 10-12 illustrate another cover embodiment, cover 66. In this embodiment, the clip is in the form of six clip legs 68 in a circular array and having outer engagement surfaces including indents 70. Also included in cover 26 are elongated abutment members 72.

In use, the cover is positioned on the CFL by inserting the clip legs 68 into the interior defined by lamp coils 22, 24 until indents 70 on the outer surfaces of the clip legs engage and receive the coils to provide releasable attachment of the cover. The abutment members 72 act as spacers to prevent the cover body from engaging the coils. Instead, the abutment members 72 engage the tubular lamp cross-member to limit such movement.

FIGS. 13-17 illustrate yet another embodiment of the cover, cover 76. Cover 76 includes a cover body 78 and a clip 80. The clip 80 includes clip legs 82 for releasably engaging a tubular lamp cross-member 26.

This embodiment is of two-part construction, the clip 80 being rotatably mounted on cover body 78. In the arrangement illustrated, the clip 80 has a socket 84 which releasably receives a ball 86 projecting from the cover body. This ball and socket joint allows rotation of the cover body relative to the clip and relative to the lamp 16, for example to place a decorated cover at a position displaying the decoration to best effect.

Figure 18:
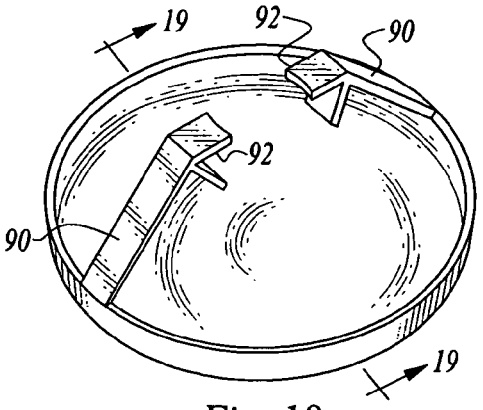
FIG. 18 is a perspective view of a fifth cover embodiment.
Figure 19:
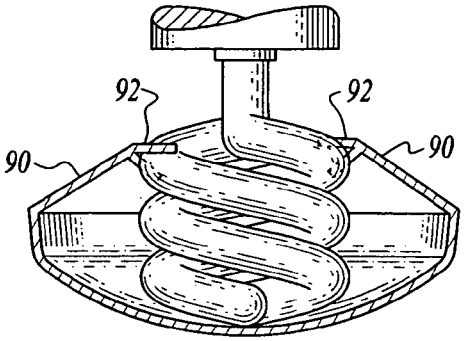
FIG. 19 is a cross-sectional view taken along line 19-19 of FIG. 18.

FIGS. 18 and 19 show an embodiment wherein a cover 88 includes a clip comprising two arms 90 having bifurcated ends 92 defining notches for receiving lamp coils 22, 24. The coils are positioned in the notches and act as "threads" enabling the cover to be threaded or unthreaded by relatively rotating the cover and lamp.

Figure 20:
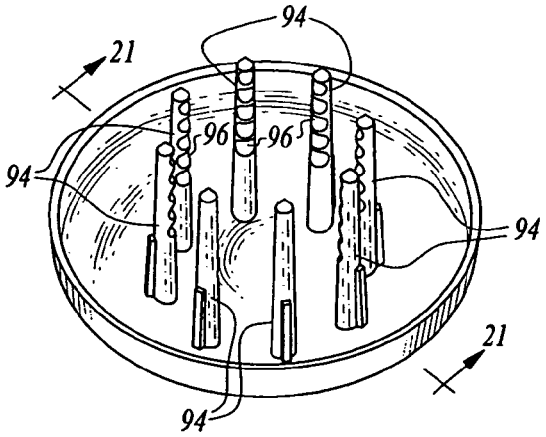
FIG. 20 is a perspective view of a sixth cover embodiment.
Figure 21:
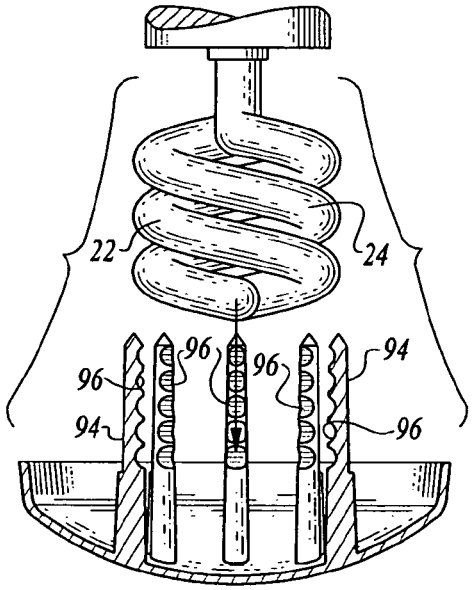
FIG. 21 is a cross-sectional view taken along line 21-21 of FIG. 20.

The embodiment of FIGS. 20, 21 is similar to that of FIGS. 10-12 except that the clip is in the form of clip legs 94 having indents 96 extending inwardly. The eight clip legs are far enough apart that they engage the outer surfaces of the coils, the indents releasably attaching the cover to the coils at selected alternative locations thereon.

The embodiments disclosed are exemplary only and other changes can be made to the invention without departing from the spirit and scope of the invention as claimed. For example, the cover body can have different shapes, sizes and colors. The cover can be designed to diffuse or focus light and can be decorated or non-decorated.

The invention claimed is:

1. In combination:

a spiral-type compact florescent lamp having lamp coil structure including lamp coils; and a cover including a cover body translucent over at least a portion thereof and a connector extending from said cover body to said compact fluorescent lamp and connecting said cover to said compact fluorescent lamp with said cover body disposed adjacent to said lamp coil structure and covering said lamp coil structure, said connector comprising a clip releasably engaging said lamp coil structure, and including a plurality of clip legs having bifurcated ends defining notches for receiving said lamp coils and providing a threaded relationship between said cover and lamp coils.

2. A cover for connection to a spiral-type compact florescent lamp having lamp coil structure, said cover including a cover body translucent over at least a portion thereof and a connector extending from said cover body for the purpose of connecting said cover to said compact fluorescent lamp with said cover body disposed adjacent to said lamp coil structure and covering said lamp coil structure, said connector comprising a clip for releasably engaging said lamp coil structure, and including clip legs defining notches for receiving lamp coils of said lamp coil structure to provide a threaded relationship between said cover and lamp coils.

* * * * *